US011828101B2

(12) United States Patent
Jaskiewicz et al.

(10) Patent No.: US 11,828,101 B2
(45) Date of Patent: Nov. 28, 2023

(54) DOOR FRAME COVER

(71) Applicant: Endura Products, LLC, Colfax, NC (US)

(72) Inventors: Tomasz Jaskiewicz, Oak Ridge, NC (US); Stephen Simon, Winston-Salem, NC (US); Adam Kendall, Burlington, NC (US)

(73) Assignee: Endura Products, LLC, Colfax, NC (US)

( * ) Notice: Subject to any disclaimer, the term of this patent is extended or adjusted under 35 U.S.C. 154(b) by 0 days.

(21) Appl. No.: 17/475,650

(22) Filed: Sep. 15, 2021

(65) Prior Publication Data

US 2022/0081955 A1 Mar. 17, 2022

Related U.S. Application Data

(60) Provisional application No. 63/079,576, filed on Sep. 17, 2020.

(51) Int. Cl.

| | |
|---|---|
| ***E06B 1/34*** | (2006.01) |
| ***E06B 1/52*** | (2006.01) |
| ***E06B 1/00*** | (2006.01) |
| ***E06B 1/28*** | (2006.01) |
| ***E06B 1/30*** | (2006.01) |
| ***E06B 1/32*** | (2006.01) |
| ***E06B 7/28*** | (2006.01) |
| *E06B 1/62* | (2006.01) |

(52) U.S. Cl.

CPC ..... *E06B 1/34* (2013.01); *E06B 1/00* (2013.01); *E06B 1/28* (2013.01); *E06B 1/30* (2013.01); *E06B 1/32* (2013.01); *E06B 1/52* (2013.01); *E06B 7/28* (2013.01); *E06B 2001/622* (2013.01)

(58) Field of Classification Search

CPC ..... E06B 1/34; E06B 1/08; E06B 1/28; E06B 1/30; E06B 1/32; E06B 1/52; E06B 7/28; E06B 2001/622

See application file for complete search history.

(56) References Cited

U.S. PATENT DOCUMENTS

| | | | | |
|---|---|---|---|---|
| 3,609,928 | A * | 10/1971 | Mock | E06B 1/30 52/214 |
| 4,330,972 | A | 5/1982 | Sailor | |
| 4,430,830 | A | 2/1984 | Sailor | |
| 5,058,323 | A | 10/1991 | Gerritsen | |
| 5,182,880 | A * | 2/1993 | Berge, Jr. | E06B 1/34 49/504 |
| 5,203,130 | A | 4/1993 | Freelove | |
| 6,125,605 | A | 10/2000 | Young | |
| 6,568,137 | B2 * | 5/2003 | Ballantyne | E06B 1/342 52/211 |
| 6,604,334 | B2 * | 8/2003 | Rochman | E06B 1/34 52/717.06 |
| 7,204,059 | B2 | 4/2007 | Schiffmann et al. | |
| 7,971,400 | B2 * | 7/2011 | Boldt | E06B 3/302 52/656.2 |

(Continued)

*Primary Examiner* — Jessie T Fonseca

(74) *Attorney, Agent, or Firm* — Womble Bond Dickinson (US) LLP

(57) ABSTRACT

Door frame cover overlay systems, devices, and methods are shown and described. A frame cover overlay for an existing door frame may include a base and a removable top. The cover overlay may be secured to the existing door frame to provide protection against further damage.

21 Claims, 10 Drawing Sheets

(56) References Cited

U.S. PATENT DOCUMENTS

| | | | | |
|---|---|---|---|---|
| 9,273,480 | B2 | 3/2016 | Larochelle | |
| 9,759,006 | B2 | 9/2017 | Davis | |
| 2004/0098940 | A1 | 5/2004 | Latessa et al. | |
| 2005/0257455 | A1* | 11/2005 | Fagan | E06B 1/26 52/210 |
| 2006/0123720 | A1 | 6/2006 | Liu | |
| 2013/0263536 | A1* | 10/2013 | Peck | E06B 1/34 52/211 |
| 2018/0223589 | A1* | 8/2018 | Chubb | E06B 1/52 |
| 2019/0128048 | A1* | 5/2019 | MacDonald | E06B 1/32 |
| 2021/0062577 | A1* | 3/2021 | Hendry | E06B 9/24 |
| 2021/0071472 | A1* | 3/2021 | MacDonald | E06B 1/32 |

* cited by examiner

DOOR FRAME COVER

This application claims the benefit of U.S. provisional application No. 63/079,576, filed Sep. 17, 2020, which is incorporated herein by reference in its entirety.

FIELD OF THE TECHNOLOGY

The present disclosure relates generally to a door frame cover, and more particularly to a system, method, and device for a door frame for covering existing damage and protecting the frame from further damage.

BACKGROUND

Door frames are susceptible to damage due to ingress and egress of people, animals, furnishings, and outside exposure. The extent of damage can widely vary, thus making repairs challenging. Conventionally, in some cases, the level of damage exceeds the ability for an acceptable repair, leaving frame replacement as the only option. Replacement often is done by swapping out the entire door assembly. However, replacement can be detailed, very costly and outside the scope of a typical homeowner.

In some instances, coverings have been attempted but Applicant realizes they are either not durable, not sustainable, or are very complicated to install. It is to these and additional challenges the inventions of the present disclosure are directed. Applicant desires to improve replacement options without the drawbacks presented by the traditional systems and methods.

SUMMARY

In accordance with the present disclosure, a door frame cover overlay is provided for a door frame for covering up existing damage and protecting the frame from further damage. This disclosure provides improved door frame cover systems, methods, and devices that are economical, durable, and easy to apply for the user.

In one embodiment, a door frame cover for covering up existing frame damage, which is resistant to further damage is disclosed.

One example of a door frame cover overlay for an existing door frame includes a base and a removable top. The base may include a trim replacement portion and a frame overlay portion. The portions may perpendicularly align to form an L-shape corner along the base. The top may be adapted to fit with the base and form an enclosed open section. The cover overlay may be secured to the existing door frame to provide protection against further damage.

The base may include a first leg and a second leg. The top may include a first top arm and a second top arm. The first top arm, and the second top arm in some examples form a substantially U-shaped top. The first top arm and second top arm may fit over the first leg and second leg respectively. The first leg may be offset from a terminal end of the trim replacement portion.

The first top arm may cover the first leg and form a substantially linear surface with an end of the trim replacement portion.

In certain examples, a door frame cover overlay is a wood and plastic composite overlay. A door frame cover overlay may include an adhesive on an inside surface of the base.

In certain examples, a door frame cover overlay may include an extrusion. Extrusions may be made from a wood/plastic composite. The wood/plastic composite may overlap and attach to existing, damaged frames. Profiles are adaptable to a variety of frame widths. The extrusions provide resistance to further damage due to material hardness and toughness. The door frame cover overlay may include UV resistant elements and provide for a pre-finished surface, or alternatively by way of example, may be finished with a field-applied topcoat. Removable tops may include profiles to replace damaged brickmould or other profiles of trim typically used with a door assembly. In exemplary instances, the outer surface of the door frame cover overlay may mimic the appearance of an existing door frame member. An outer surface of the top may form a brickmould.

The frame overlay portion may include an extender receiver. The extender receiver may be offset from the frame overlay portion. The frame overlay portion may be adaptable to a variety of frame widths by use of an extender. In certain embodiments, the frame overlay portion includes a notched segment for removing the extender receiver.

One embodiment of the present disclosure includes a core. The core may be enclosed within the base and the top inside the enclosed open section.

The invention may be considered in some examples a door frame assembly including door frame members and a door frame cover overlay.

The invention may be considered a method for covering a damaged door frame according to any of the embodiments disclosed herein.

The invention may be considered a system for covering a damaged door frame according to any of the embodiments disclosed herein.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
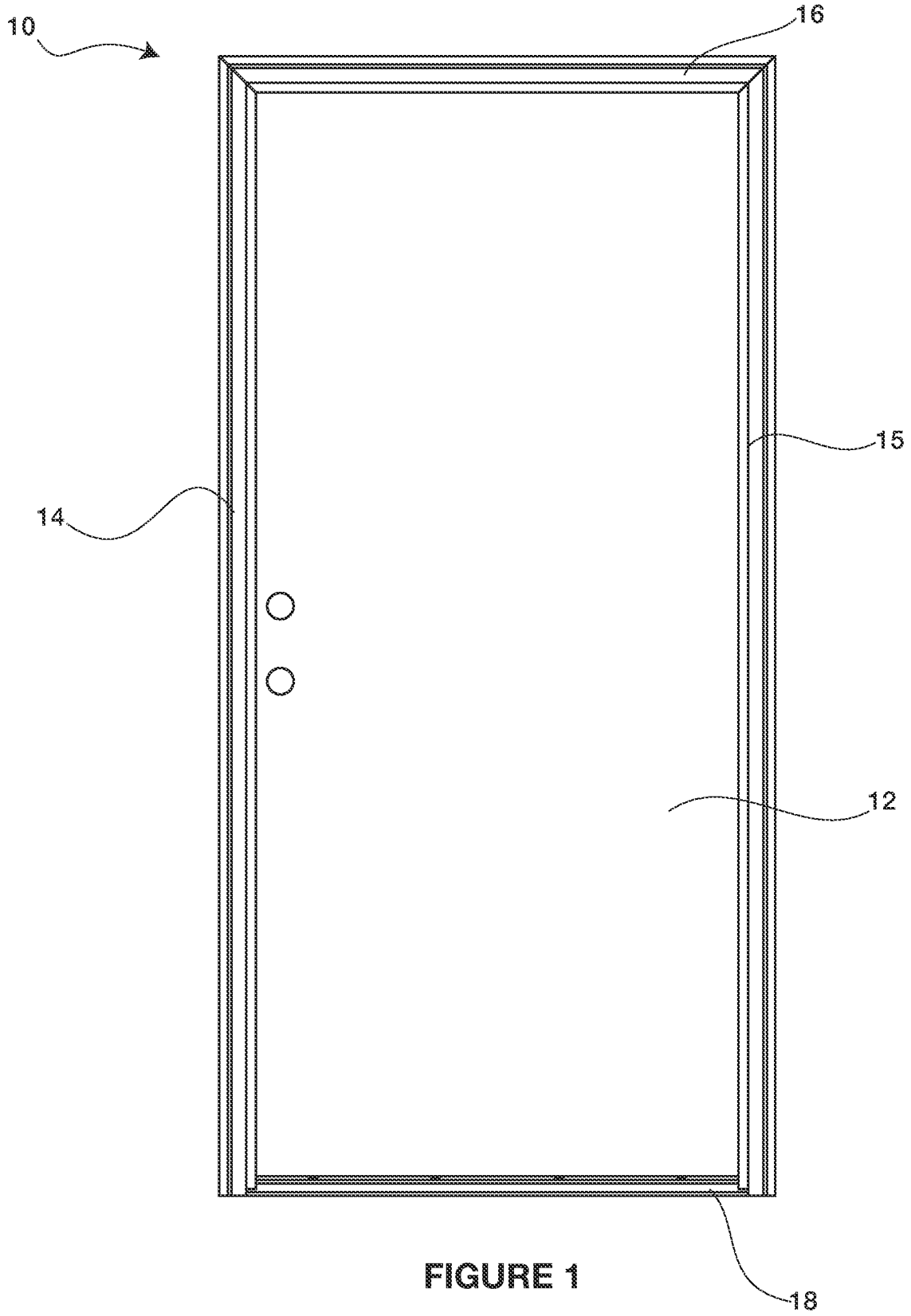
FIG. 1 is one example of a front view of a door frame assembly according to an embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general and FIG. 1 in particular, it will be understood that the illustrations are for the purpose of describing embodiments of the disclosure and are not intended to limit the disclosure or any invention thereto. As best seen in FIG. 1, in one embodiment, a door frame assembly 10 may include frame members 14, 15, 16, 18. Door frame members may include, but are not limited to, door jambs 14, 15, mullions, door sills 18, and door headers 16. The door frame assembly may include a door panel 12 and a trim, for example a brickmould.

Figure 2:
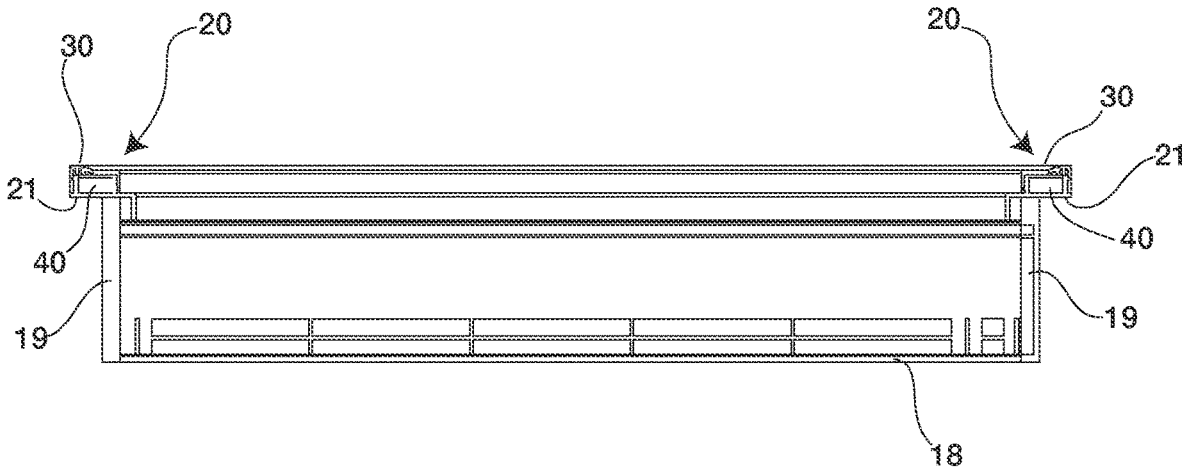
FIG. 2 is a bottom view of a door frame assembly including a door frame cover overlay according to FIG. 1.

FIG. 2 shows a bottom view of the door frame assembly of FIG. 1, and includes an existing door frame 19 installed with the door frame assembly. A door frame cover 20 may be included for covering up existing frame damage, which is resistant to further damage. A door frame cover 20 may be an overlay. A door frame cover 20 may be attached to an existing door frame 19. Door frame cover 20 may include a base 21 and a top 30. The top 30 may be a removable top. A core 40 may be enclosed in open section 31 between base 21 and top 30.

Figure 3:
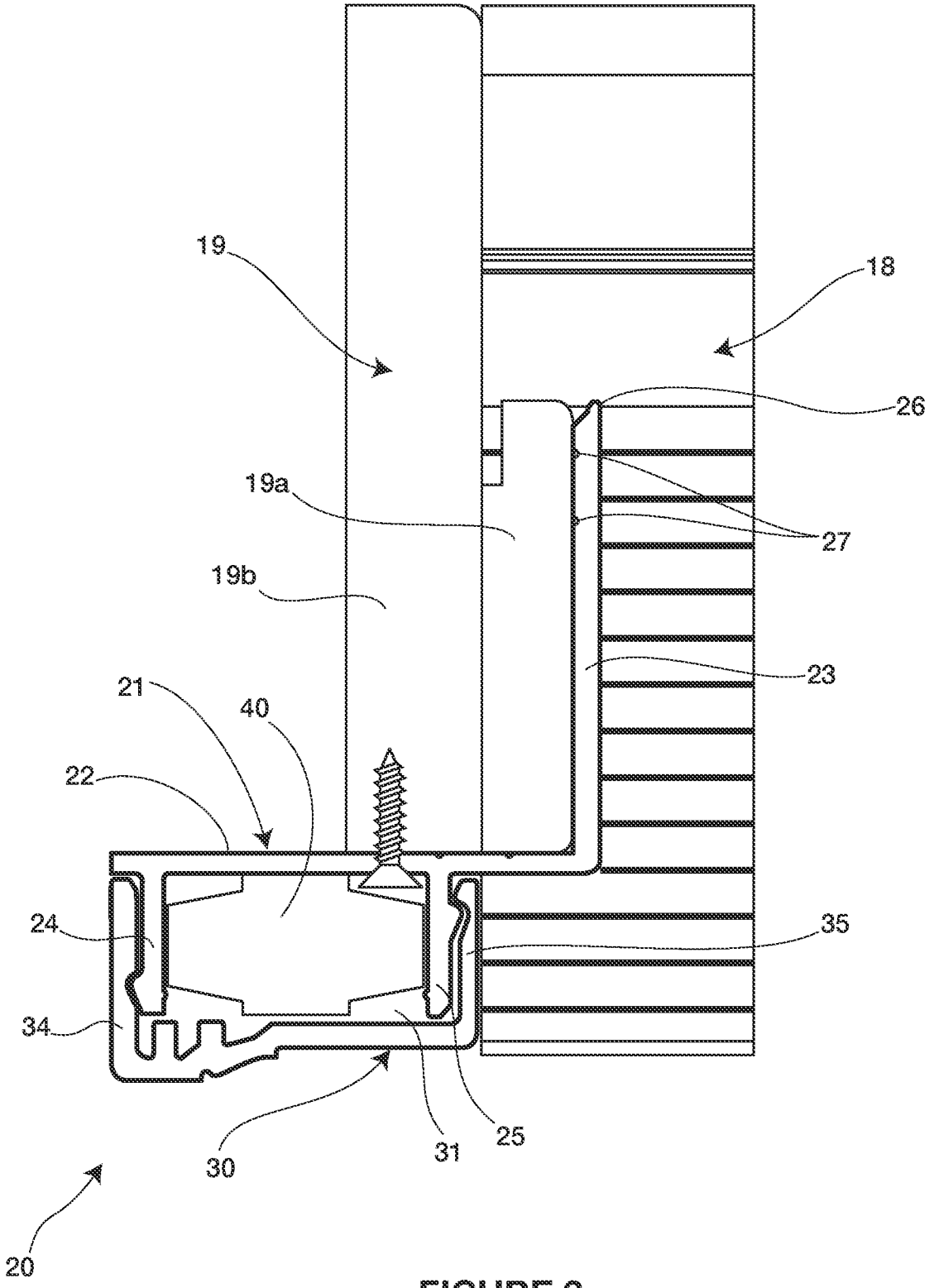
FIG. 3 is a cross-sectional view of one example of a door frame cover overlay according to one example of the disclosure.

FIG. 3 shows one example of a door frame cover 20 in cross-section. One embodiment of a door frame cover overlay 21 for an existing door frame includes a base 21 and a removable top 30. The base 21 may include a trim replacement portion 22 and a frame overlay portion 23. The portions may perpendicularly align to form an L-shape corner along the base 21. The top 30 may be adapted to fit with the base 21 and form an enclosed open section 31. The cover overlay 20 may be secured to any part of the existing door frame 19 (for example the 19*a* stop portion and 19*b* rabbet portion) to provide protection against further damage. The cover overlay 20 may, by way of example, be secured with adhesive, screws, nails, snaps, friction, hooks, etc.

Figure 4:
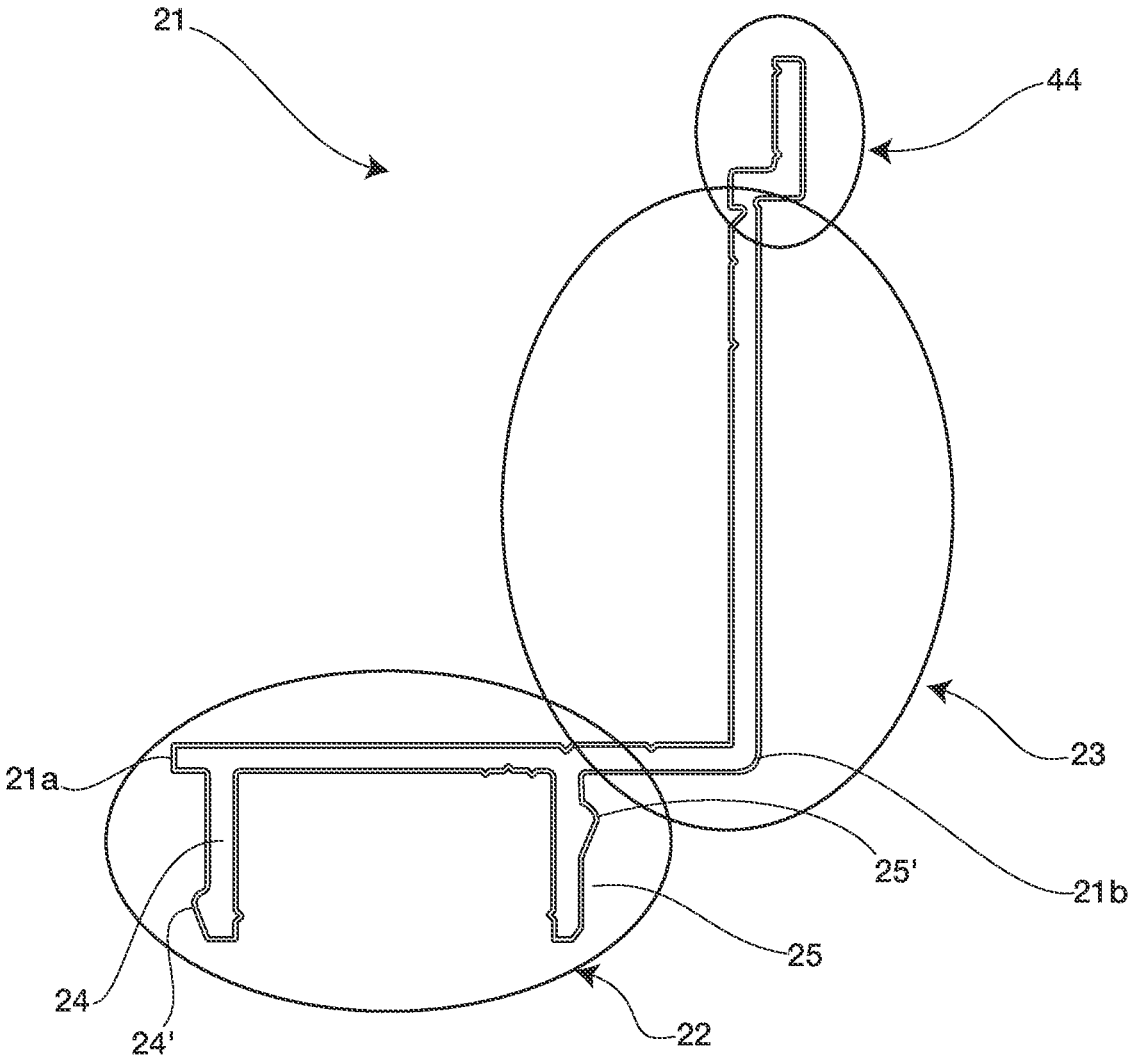
FIG. 4 is a close up view of one example of a base of the door frame cover overlay according to FIG. 3.
Figure 5:
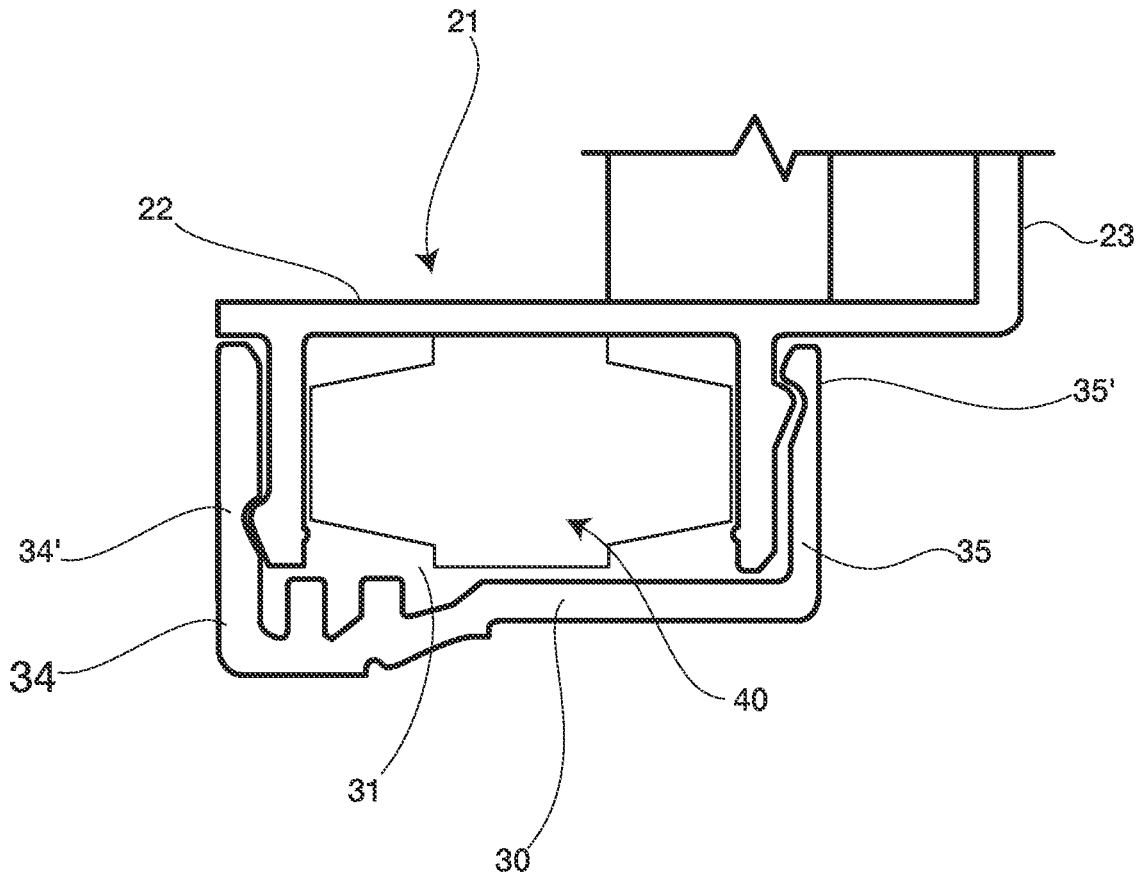
FIG. 5 is a cross-sectional close-up view of one example of a base including a core according to an embodiment of FIG. 3.
Figure 6:
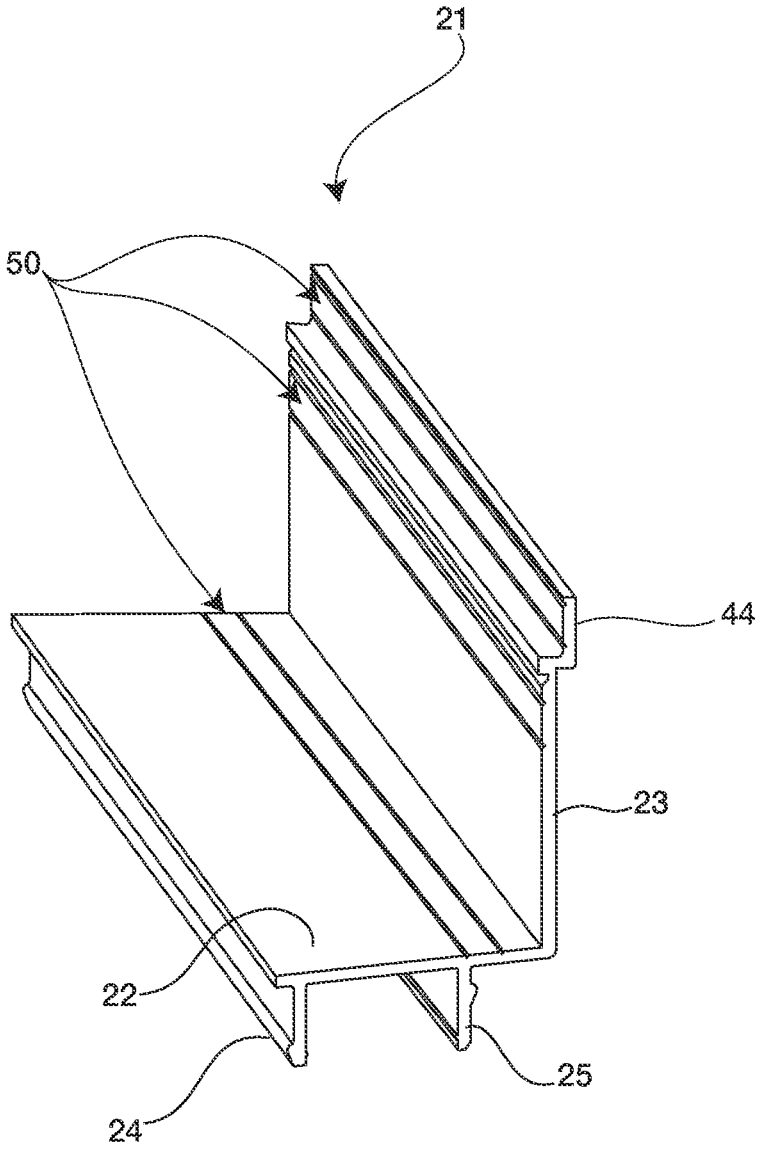
FIG. 6 is a perspective view of one example of a base of the door frame cover overlay according to the disclosure.

The base 21, as seen in FIGS. 3, 4, and 6, may include a first leg 24 and a second leg 25. The top 30 may include a first top arm 34 and a second top arm 35. The first top arm 34, and the second top arm 35, in some examples form a substantially elongated U-shaped top. The first top arm 34 and second top arm 35 may fit over the first leg 24 and second leg 25 respectively. The first leg 24 may be offset from a terminal end of the trim replacement portion 21*a*.

The first top arm 34 may cover the first leg 24 and form a substantially linear surface with an end of the trim replacement portion 22. The second leg 25 may be spaced apart from a corner end 21*b* of the trim replacement portion. The legs 24 and 25 may include notches 24', 25'. The notches may be projections or indentations along the legs 24, 25. The notches 24', 25' may be wedge shaped, angular and/or, by way of example, curved.

The top 30 may include a first top arm 34 and a second top arm 35 that mate with the first leg 24 and second leg 25 to surround the legs 24, 25. Each arm may include a notch 34', 35'. The notches 34', 35' may be projections or indentations along the arms 34, 35. The notches 34', 35' may be wedge shaped, angular and/or by way of example, curved. The notches 34', 35' may align with the notches 24', 25' to form a pressure or latching connection between them to secure the top 30 onto trim replacement portion 22.

The top 30 may include a trim surface. The trim surface may be considered a brickmould. The trim surface may be matched to a trim surface on the existing door frame assembly. The trim surface may extend between the first top arm 34 and second top arm 35.

In certain examples, a door frame cover overlay 20 is a wood and plastic composite overlay. A door frame cover overlay may include an adhesive 50 on an inside surface of the base. In one example, adhesive strips may be included along an inside face of the trim replacement portion 22, the frame overlay portion 23 and/or an extender receiver 44.

In certain examples, a door frame cover overlay 21 may include an extrusion. Extrusions may be made from a wood/plastic composite. The wood/plastic composite may overlap and attach to existing, damaged frames. Profiles are adaptable to a variety of frame widths. The extrusions provide resistance to further damage due to material hardness and toughness. The door frame cover overlay may include UV resistant elements and provide for a pre-finished surface, or alternatively by way of example, may be finished with a field-applied topcoat. Removable tops may include profiles to replace damaged brickmould or other profiles of trim typically used with a door assembly. In exemplary instances, the outer surface of the door frame cover overlay may mimic the appearance of an existing door frame member. An outer surface of the top may form a brickmould.

Figure 7:
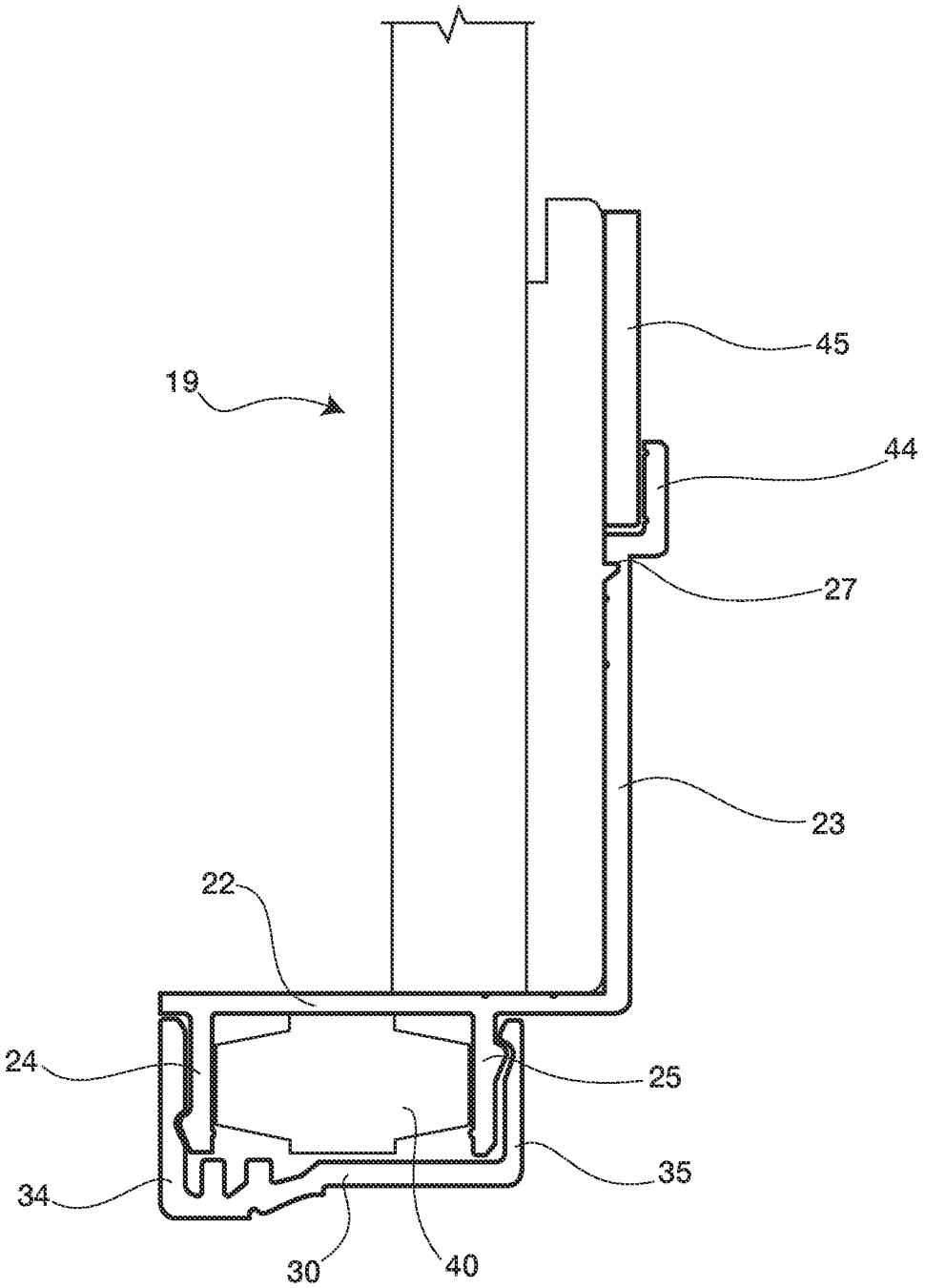
FIG. 7 is a cross-sectional view of one example of a door frame assembly including an extender receiver according to examples of the disclosure.
Figure 8A:
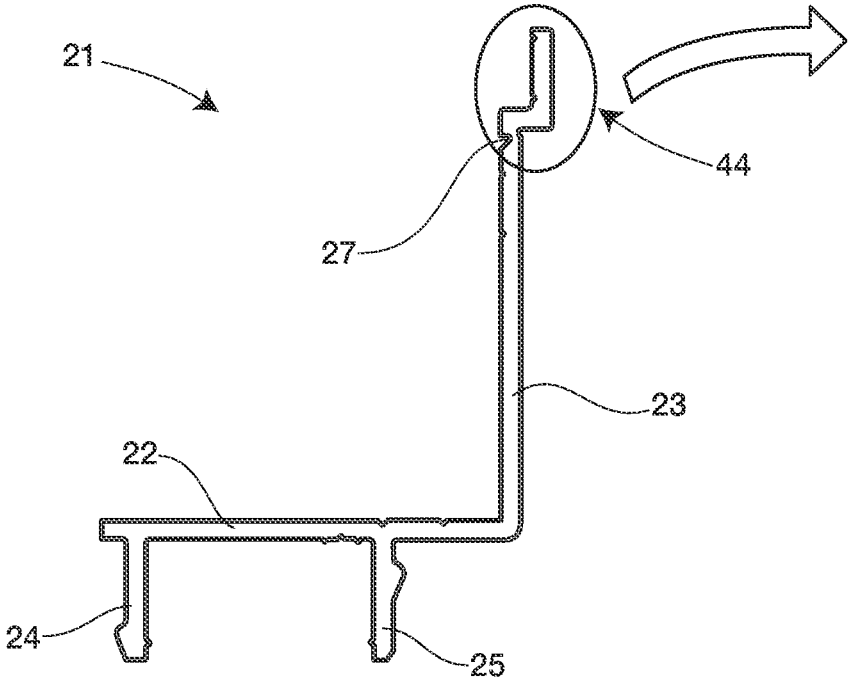
FIGS. 8A-8B illustrate a base including an extender receiver that may be removed to adjust the size of the base.
Figure 8B:
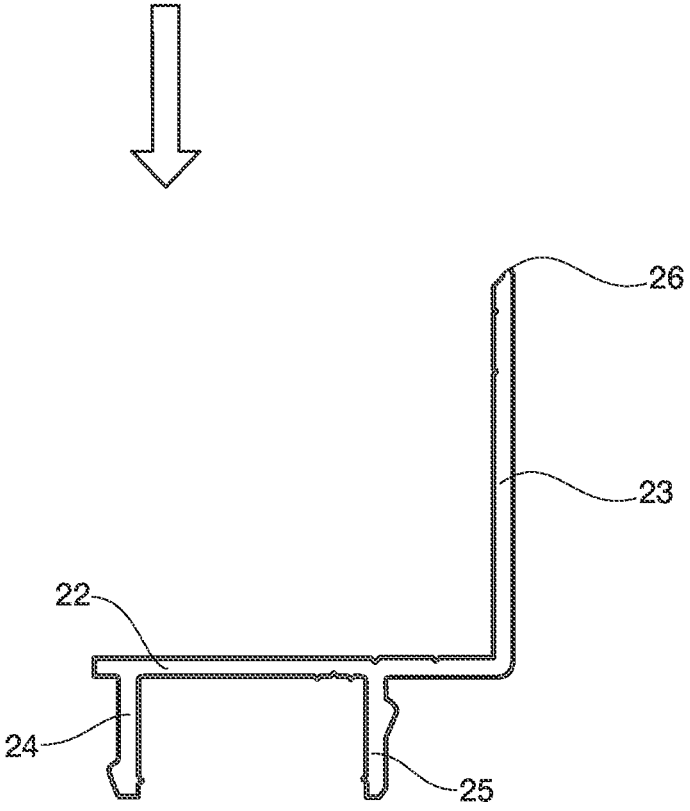
Figure 9:
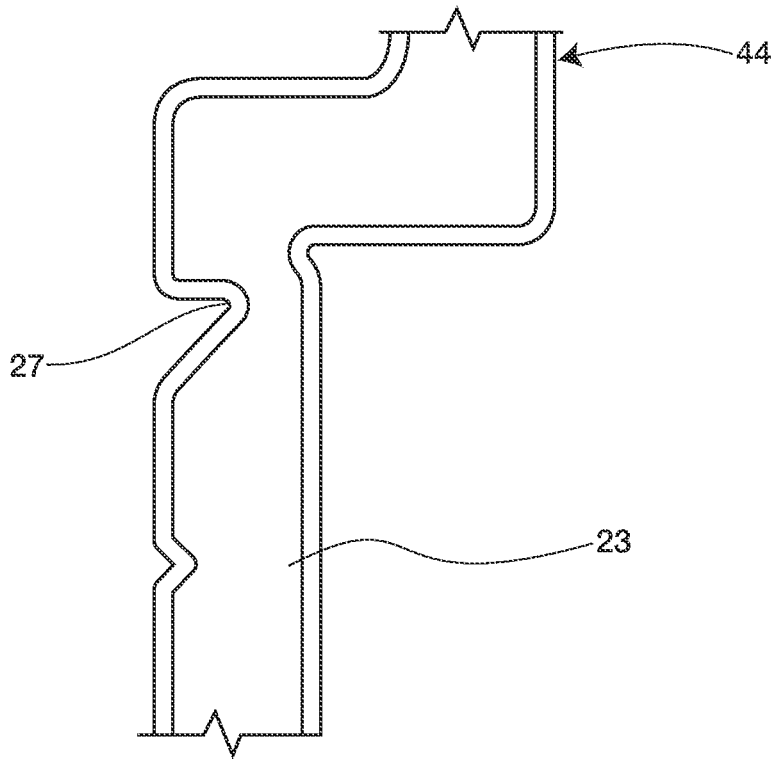
FIG. 9 is a close-up view of a base including a notched segment according to one example of the disclosure.
Figure 10:
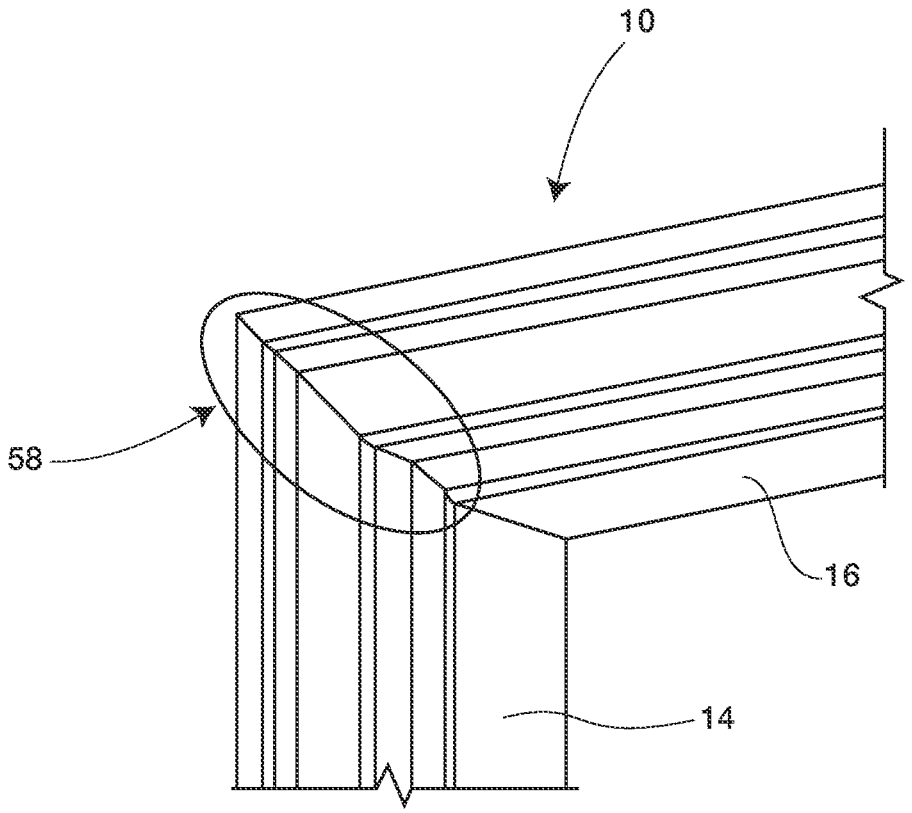
FIG. 10 illustrates an example of a door frame assembly with miter cut portions joined with a fastener and including a door frame cover overlay.

The frame overlay portion 23 may include an extender receiver 44. The extender receiver 44 may be offset from the frame overlay portion 23. The frame overlay portion 23 may be adaptable to a variety of frame widths by use of an extender 45, shown in one example in FIG. 7. The extender receiver 44 may mate with the extender 45 to secure the extender 45 in place along wider frame members. In certain embodiments, the frame overlay portion 23 includes a notched segment 27 for removing the extender receiver and making the frame overlay portion 23 adapted to adjust to different size door frame members (see FIGS. 8A and 8B). There may be one or more notched segments 27, an example of which is shown in FIG. 9. The extender receiver 44 may be removable to expose a terminal end 26 along the frame overlay portion 23.

One embodiment of the present disclosure includes a core 40. The core may be enclosed within the base 21 and the top 30 inside the enclosed open section 31. The core 40 may be used to receive fasteners for securing a storm or screen door. The core may be miter cut and joined with a fastener prior to attaching covers so that smooth joint corners are formed 58 in frame members of the assembly 10.

The invention may be considered in some examples a door frame assembly including door frame members and a door frame cover overlay 10. The door frame cover overlay may attach to existing frame members and existing door sill, and/or parts of the existing frame assembly may be replaced when the door frame cover overlay 10 is attached to the door frame assembly.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A door frame cover overlay for an existing door frame comprising:

a base having a trim replacement portion and a frame overlay portion, the trim replacement portion and the frame overlay portion perpendicularly aligned to form an L-shape corner in the base, the trim replacement portion including a first leg and a second leg that each extend perpendicularly from the trim replacement portion of the base;

a removable top adapted to fit with the base to form an enclosed open section, the removable top including a body and a pair of arms, the entire removable top separated from the door frame by the base, the body being substantially linear between a first end and a second end thereof, each arm of the pair of arms extending from a respective one of the first end and the second end of the body, each arm of the pair of arms fitted with a respective one of the first leg and the second leg to secure the removable top to the base;

a core disposed within the enclosed open section formed between the base and the removable top, the cover overlay configured to secure to the existing door frame to provide protection against further damage.

2. The door frame cover overlay of claim 1, wherein the first leg and the second leg each meet on one end with the base.

3. The door frame cover overlay of claim 2, wherein the top includes, the pair of arms including a first top arm and a second top arm.

4. The door frame cover overlay of claim 3, wherein the body, the first top arm, and the second top arm form a substantially, elongated U-shaped top.

5. The door frame cover overlay of claim 4, wherein the base includes notches for securing the top to the base.

6. The door frame cover overlay of claim 5, wherein the first top arm and the second top arm fit over the first leg and the second leg respectively.

7. The door frame cover overlay of claim 4, wherein the first leg is offset from a terminal end of the trim replacement portion.

8. The door frame cover overlay of claim 7, wherein the first top arm covers the first leg and forms a substantially linear surface with the terminal end of the trim replacement portion.

9. The door frame cover overlay of claim 1, wherein the door frame cover overlay is formed of a composite of wood and plastic.

10. The door frame cover overlay of claim 1, further including an adhesive on an inside surface of the base.

11. The door frame cover overlay of claim 1, wherein the frame overlay portion includes an extender receiver.

12. The door frame cover overlay of claim 11, wherein the extender receiver is offset from the frame overlay portion.

13. The door frame cover overlay of claim 11, wherein the frame overlay portion is adaptable to a variety of frame widths by use of the extender receiver.

14. The door frame cover overlay of claim 12, wherein the frame overlay portion includes a notched segment for removing the extender receiver.

15. The door frame cover overlay of claim 1, wherein an outer surface of the door frame cover overlay mimics the appearance of an existing door frame member.

16. The door frame cover overlay of claim 15, wherein an outer surface of the top forms a brickmould.

17. The door frame cover overlay of claim 1, wherein the trim replacement portion covers an existing outer frame surface and the frame overlay portion covers an inner frame surface.

18. The door frame cover overlay of claim 1, wherein the core is accessible by way of the removable top.

19. A method for covering a door frame with an overlay comprising:

combining a trim replacement portion and a frame overlay portion to form a base, aligning the trim replacement portion and the frame overlay portion perpendicularly to form an L-shape corner in the base that extends along a length of a stop portion of the door frame and along a width of a rabbet portion of the door frame, spacing apart a first leg and a second leg from either terminal end of the trim replacement portion, fitting a removable top with the base to form an enclosed open section, the top including a body, flanked by a first arm and a second arm, collectively forming a U-shaped top, the enclosed open section defined by the trim replacement portion, the first leg, the second leg, and the body, and securing the overlay to the door frame to provide a protective barrier against further damage, extending the first leg and the second leg perpendicularly from the trim replacement portion of the base, fitting in a substantially parallel manner the first leg with the first arm and the second leg with the second arm, with the first arm and the second arm substantially spanning the distance between the trim replacement portion and the body.

20. A door frame cover overlay for an existing door frame comprising:

a base having a trim replacement portion and a frame overlay portion, the trim replacement portion and the frame overlay portion perpendicularly aligned to form an L-shape corner in the base, the trim replacement portion including a first leg and a second leg spaced apart from either terminal end of the trim replacement portion, wherein the frame overlay portion is configured to extend a length of a stop portion of the existing door frame, and the trim replacement portion is configured to extend a length of a rabbet portion of the existing door frame, a removable top adapted to fit with the base to form an enclosed open section, the removable top including a body, flanked by a first arm and a second arm such that the removable top defines a U-shape, the body being substantially linear between the first arm and the second arm, wherein the cover overlay is configured to secure to the existing door frame to provide a protective barrier against further damage with the removable top fitting over a U-shaped segment of the trim replacement portion formed by the first leg, a section of the base between the first leg and the second leg, and the second leg, the first arm and the second arm substantially spanning the distance between the trim replacement portion and the body.

21. The door frame cover overlay of claim 20, further including a core adapted to fit within the first leg and the second leg of the base, and adapted to be enclosed with the base and the removable top when the removable top is attached to the base.

* * * * *